United States Patent [19]

Arens

[11] Patent Number: 4,729,687

[45] Date of Patent: Mar. 8, 1988

[54] IMAGING DEVICE

[75] Inventor: Robert P. Arens, North St. Paul, Minn.

[73] Assignee: Minnesota Mining and Manufacturing Company, St. Paul, Minn.

[21] Appl. No.: 911,735

[22] Filed: Sep. 26, 1986

Related U.S. Application Data

[63] Continuation of Ser. No. 703,300, Feb. 20, 1985, abandoned.

[51] Int. Cl.[4] ..... B43K 23/00

[52] U.S. Cl. ..... 401/198; 401/199; 401/196; 427/161; 428/304.4; 428/321.1

[58] Field of Search ..... 401/198, 199, 196; 427/161; 428/304.4, 321.1

[56] References Cited

U.S. PATENT DOCUMENTS

| | | | |
|---|---|---|---|
| 2,299,991 | 10/1942 | Kallock | 234/74 |
| 2,854,350 | 9/1958 | Phillpotts | 117/36 |
| 3,031,328 | 4/1962 | Larson | 117/36.7 |
| 3,247,006 | 4/1966 | Hoge et al. | 117/36.7 |
| 3,508,344 | 4/1970 | Thomas | 35/9 |
| 3,684,389 | 8/1972 | Eron et al. | 401/207 |
| 3,887,287 | 6/1975 | Rosh, Jr. | 401/198 |
| 4,299,480 | 11/1981 | Gilkeson et al. | 355/66 |
| 4,418,098 | 11/1983 | Maistrovich | 427/161 |

*Primary Examiner*—John Kight
*Assistant Examiner*—M. L. Moore
*Attorney, Agent, or Firm*—Donald M. Sell; James A. Smith; Richard E. Brink

[57] ABSTRACT

Improved imaging device for applying temporary indicia to substrate of the type having a base covered with a relatively light color, opaque, open cell microvoid-containing layer that is rendered translucent when the microvoids are filled with a liquid having a refractive index similar to that of the layer. The improvement in the imaging device involves insuring that the imaging liquid contains no substance having an evaporation rate less than about one-half of the liquid, thereby permitting the imaging device to be repeatedly applied to the same area of the substrate without leaving ghost images.

5 Claims, No Drawings

IMAGING DEVICE

This is a continuation of application Ser. No. 703,300 filed Feb. 20, 1985, now abandoned.

BACKGROUND OF THE INVENTION

This invention relates to imaging devices and is particularly concerned with devices for applying clear, colorless imaging fluids to an opaque open-cell microvoid-containing layer overlying a contrasting substrate.

Several U.S. patents (e.g., Kallock U.S. No. 2,299,991, Larsen U.S. Pat. No. 3,031,328 and Thomas U.S. Pat. No. 3,508,344) disclose composite sheet material wherein a light-colored opaque blushed lacquer layer is coated over a base sheet which is either dark-colored or imprinted with contrasting indicia. The opacity and light color of the blushed lacquer coating are due to the inclusion of numerous microvoids; the local application of (1) heat or pressure (either of which irreversibly collapses the microvoids) or (2) a non-solvent liquid (which fills the microvoids), causes the coating to become selectively transparent or translucent and the underlying backing to become visible. An innocuous non-solvent liquid employed to impart transparency to the opaque microporous layer can subsequently be evaporated to restore the original appearance. A liquid that is a solvent for the lacquer coating would, of course, result in permanent transparency by collapsing the microvoids.

Phillpotts U.S. Pat. No. 2,854,350 describes structures which are functionally similar to those just described, except that the blushed lacquer coatings are replaced by a microporous layer of finely divided calcium carbonate in an organic binder. Transparency is imparted by locally applying pressure or treating selected areas with a wax, oil or grease having a refractive index similar to that of the calcium carbonate. Other pigments may be incorporated in a microporous highly plasticized resin binder; see Hoge et al. U.S. Pat. No. 3,247,006.

It is sometimes desirable to have microvoid-containing sheet material which can be repeatedly transparentized by applying a liquid, but which cannot readily be transparentized by the application of heat or pressure. In such circumstances, a microvoid-containing layer of the type described in Arens U.S. Pat. No. 4,299,880, owned by applicant's assignee, is preferred. This patent discloses a structure in which the microvoid-containing layer consists essentially of particles held in pseudo-sintered juxtaposition by a thermoset binder and has a cohesion value of at least 400 grams force*.

*The cohesion value is determined by knife-coating a dispersion of a putative composition on a cleaned gray cold rolled steel panel, drying and curing as appropriate for the composition, to provide a coating 50–60 micrometers thick. Using a "Balance Beam Scrape-Adhesion and Mar Tester", sold by Gardner Laboratories, Inc., Bethesda, Md., a sapphire-tipped stylus is lowered into contact with the test panel and held in fixed position while a ball bearing-supported platform moves the panel. The minimum grams-force required to form a 50-micrometer deep scratch in the coating in a single pass is determined at a magnification of 40× and reported as cohesive value.

Products of the type just discussed can be further improved by incorporating in the microvoid layer an organic polymer that jellifies the transparentizing liquid and blocks lateral migration, thus permitting indicia to retain their initial sharpness.

Where the microvoid coating is sufficiently durable (especially, one of the type described in U.S. Pat. No. 4,199,880) it can be reused many times, thus making it attractive for incorporation in student's workbooks, overhead transparencies, computer cards, cards for use as optical character recognition devices, bingo cards, stenographic pads, easel pads, games, etc. Microvoid layers of this type can also be applied to the surface of three-dimensional objects, making it possible to develop such unusual toys as a doll whose apparently pale lips become temporarily rosy-red when a transparentizing "lipstick" is applied to reveal the underlying color. For all applications of this type, it is important that evaporation of the transparentizing liquid be complete, so that the original appearance is restored. As is taught in U.S. Pat. Nos. 4,299,880 and 4,418,098, the specific marking fluid is chosen in large part on the basis of its evaporation rate, which is inversely related to image duration.

There are many ways in which a transparentizing liquid can be applied to the surface of a microvoid-containing layer, e.g., by a stamp pad, typewriter ribbon, sponge, etc., but a particularly preferred imaging device is a pen having a porous nib made of felt, extruded polymer, compressed fiber bundles, etc. Unfortunately, however, when a transparentizing liquid is incorporated in an imaging device, the anticipated number of uses possible is substantially less than would have been predicted. In some instances, as few as two applications of the imaging device to the same area of a given microvoid substrate has resulted in the presence of a "ghost" image that is permanently visible.

BRIEF DESCRIPTION

After extensive investigation, the applicant has determined that purity of the imaging fluid is of great significance in obtaining an imaging device that can be used repeatedly without leaving permanent marks on the transparentizable substrate. Not only is it important to employ imaging fluids that are themselves essentially free from contaminating substances, but it is also important that the reservoir and any contacting parts of the receptacle in which it is contained by similarly free from contamination. Contamination can occur from the presence of any solid or liquid substance that dissolves in the imaging fluid and has an evaporation rate less than about one-half that of the imaging fluid. Problems arising from the application of solid contaminants can readily be appreciated. It is equally true, however, that liquid materials which evaporate far more slowly than the imaging fluid will cause a persistence of image that is highly undesirable.

The present invention provides an imaging device comprising in combination a reservoir incorporated in a receptacle, imaging fluid in the reservoir, and means for delivering the fluid from the reservoir to a location where marks are to be applied to a substrate. The imaging fluid consists essentially of a clear, colorless, and innocuous liquid; i.e., it will neither dissolve nor degrade the microporous layer to which it will be applied nor prove harmful if ingested in small quantities. Additionally, it must be completely volatilizable, having an evaporation rate on the order of 20 to $10^{-6}$ (compared to n-butyl acetate = 1). At the heart of the invention lies the fact that no more than about 500 ppm (preferably no more than 50 ppm, and still more preferably no more than about 5 ppm) by weight of the fluid constitute a contaminating substance having an evaporation rate less than about one-half of the liquid. This contaminating substance may, as previously stated, be either another liquid or a solid present in the imaging liquid. If the contaminants in the imaging fluid are present in an amount no greater than 500 ppm, the microporous substrate can be imaged and re-imaged at least about 100 times before any ghosting is noted. Decreasing the contaminant level to 50 ppm increases the number of uses to about 1,000, and further reducing the value to 5 ppm increases the number of ghost-free uses to about 10,000.

A particularly preferred embodiment of the invention is a pen of the type in which either an elongated cylindrical felt nib or a longitudinally porous relatively stiff polymeric nib extends from the reservoir to act as the writing tip. In many such constructions, the reservoir comprises a bundle of fine fibers, frequently enclosed in a tubular film sheath, which is mounted inside the pen body. Vent tubes may extend longitudinally throughout the reservoir to permit equalization of internal and external pressure as imaging fluid is drawn from the reservoir of the pen by capillary action during use. The sources of contamination in this type of construction include the plasticizers commonly incorporated in polyvinyl chloride vent tubes, surface finishes applied to the fibers during processing, the plastic sheath surrounding the fibrous reservoir, and mold release agents or low molecular weight polymers clinging to the interior of the pen barrel. All such contaminants may be removed from pen components by rinsing them in acetone, heptane, etc., or by heating them for a long enough period of time (e.g., 72 hours at 120° C.) to volatilize, oxidize, or carbonize the contaminants.

DESCRIPTION OF PRESENTLY PREFERRED EMBODIMENTS

Examples 1-3

Four identical felt-tipped pens were obtained, each having a 2-mm diameter nib and generally cylindrical shell enclosing a reservoir of polyester fibers ensheathed in a polyester film, with a pair of 1-mm o.d. plasticized polyvinyl chloride (PVC) vent tubes extending the entire length of the reservoir. The length of the reservoir was 9.3 mm and the diameter was 7.8 mm, the total volume thus being approximately 4.4 ml. To the reservoir of the control pen was then added 2.8 ml of a clear $C_9$–$C_{11}$ isoparaffin having an evaporation rate of 0.18 (n-butyl acetate=1.00; cf. ASTM Test D3539-76). The pen was mounted in a holder at a 60° angle to the horizontal and a 100-gram vertical force applied as the pen was moved along a 12.5-mm path while it was held in contact with a microvoid-containing sheet material of the type described in Example 1 of U.S. Pat. No. 4,299,880*, leaving a visible image 2 mm wide. After 5 minutes had elapsed, during which time substantially all of the isoparaffin solvent had evaporated, another stroke of the pen was made along the same path. After 5 minutes more had elapsed, the image was still visible, indicating the presence of relatively non-volatile contaminants. The reservoir was then removed from the pen and squeezed to express as much of the isoparaffin imaging liquid as possible. The liquid was then injected into a packed chromatography column (cf. ASTM Test E260-73), which revealed that the level of contaminants was approximately 50,000 ppm.

*The microvoid layer was approximately 25 micrometers thick; it appears that the contamination tolerance of an imaging liquid is directly related to the thickness of this layer. In practice, the thickness may range from about 10±2 micrometers to 40±6 micrometers. The exact nature of the components (especially fillers) of the microvoid layer may also influence specific results. subsequent drop left no perceptible residue after evaporation, after which the reservoir was air dried at least 16 hours. (The major contaminant was found to be glycerol tributyrate.)

Example 3—PVC vent tubes were removed; additionally, the receptacle and reservoir were heated at 120° C. for 72 hours before filling with isoparaffin.

Results are tabulated below:

| Example | Approximate concentration of contaminants, ppm | Approximate number of re-imaging strokes before "ghost" appears |
|---|---|---|
| Control | 50,000 | 1 |
| 1 | 10,000 | 5 |
| 2 | 500 | 100 |
| 3 | 50 | 1,000 (estimated) |

Example 4

Two felt-tipped pens, substantially identical to those of Examples 1-3, were obtained, the differences residing in the fact that the reservoir consisted of cellulose acetate fibers, no vent tubes were present, and the major contaminant was glycerol triacetate. Using a $C_7$–$C_8$ isoparaffin imaging liquid, the testing procedure of Examples 1-3 was repeated. The evaporation rate of the isoparaffins was 2.8 (n-butylacetate=1.00), and the image duration time was three seconds. In Example 4, prior to introducing the imaging liquid, the cellulose acetate fibers were removed and replaced with cellulose acetate fiber having no external lubricant prior to filling with the isoparaffin. Results are tabulated below:

| Example | Approximate concentration of contaminants, ppm | Approximate number of re-imaging strokes before "ghost" appears |
|---|---|---|
| Control | 50,000 | 1 |
| 4 | 250 | 200 |

Examples 5 and 6

Two pens substantially identical to those employed in Example 4 were obtained, the difference residing in the use of polypropylene fiber instead of cellulose acetate fiber in the reservoir. In this case the imaging fluid utilized was diisobutylketone, which has an evaporation rate of 0.14. It was found that extractable low molecular weight polypropylene still clung to the surface of the fibers. For Example 5 the shell and the fibrous reservoir were thoroughly cleansed with 1,1,1-trichloroethane and dried, following the procedures of Example 2, before adding the imaging fluid. In Example 6 the polypropylene fibers were replaced with a specially prepared dry, lubricant-free fibrillated polypropylene fiber. Results are tabulated below:

| Example | Approximate concentration of contaminants ppm | Approximate number of re-imaging strokes before "ghost" appears |
|---|---|---|
| Control | 10,000 | 5 |
| 5 | 500 | 100 |
| 6 | 33 | 1,000 (estimated) |

Example 7

A woven nylon fiber typewriter ribbon 7.8 mm long, 12.5 mm wide, and 0.12 mm thick, mounted in a polyphenylene oxide cartridge, was saturated with 5 ml diethyl adipate imaging fluid, which has an evaporation rate of 0.001. The ribbon was then mounted on a typewriter, an upper case 10-pitch Gothic H struck on sheet material of the type used in the preceding examples, and the imaging fluid evaporated. (The normal image duration of three hours was reduced by heating the imaged sheet material to 100° C. for about 30 seconds.) Another upper case H was then struck in the same place and the process repeated until a "ghost" image could be detected after heating. In Example 7, the ribbon was carefully rinsed in 1,1,1-trichloroethane (to remove light mineral oil, the major contaminant) and dried before being saturated with the diethyl adipate. Results are tabulated below:

| Example | Approximate concentration of contaminants, ppm | Approximate number of re-imaging strokes before "ghost" appears |
|---|---|---|
| Control | 2,000 | 25 |
| 7 | 50 | 1,000 |

Example 8

A control stamp pad comprising a 12.7 cm×7.6 cm×5 mm cotton felt mounted in a polypropylene container, was obtained. (This felt was found to contain light mineral oil lubricant.) The pad was saturated directly with 10 ml of tributyl citrate, which has an evaporation rate of $10^{-6}$, indicating that the expected duration of an image would be 1.5 years under room conditions. Example 8 employed a similar pad, differing in that the cotton felt of the control was replaced with a pure cellulose fiber felt ("100% Cotton Webril Handi-Pad", supplied by Kendall Company) before saturating with tributyl citrate. A clean 12.7-mm diameter circular cotton felt stamp was forced firmly into contact with the imaging fluid-containing pad and then applied to the surface of the sheet material employed in the preceding examples. Since it was clearly impractical to wait 18 months for the imaging fluid to evaporate, the imaged sheet material was heated for about 15 seconds at 175° C. after each imaging procedure. Results are tabulated below:

| Example | Approximate concentration of contaminants, ppm | Approximate number of re-imaging strokes before "ghost" appears |
|---|---|---|
| Control | 1,200 | 40 |

-continued

| Example | Approximate concentration of contaminants, ppm | Approximate number of re-imaging strokes before "ghost" appears |
|---|---|---|
| 8 | 500 | 100 (estimated) |

The product of Example 8 shows how an image can be retained for substantial periods of time and "erased" with heat when it no longer serves its purpose, permitting the sheet material to be repeatedly reused.

I claim:

1. An imaging device comprising in combination a reservoir incorporated in a receptacle, imaging fluid in said reservoir, and means for delivering said fluid from said reservoir to a location where marks are to be applied to a substrate, said imaging fluid being substantially free from contaminants and said receptacle, reservoir and delivery means all being substantially free of materials extractable by said imaging fluid, so that said imaging fluid as delivered consist essentially of clear, colorless, innocuous, completely volatilizable liquid having an evaporation rate on the order of from 20 to $10^{-6}$ (n-butyl acetate=1.00), no more than about 500 ppm of said fluid constituting a substance having an evaporation rate less than about one-half that of said liquid, whereby said device can be used repeatedly to apply indicia to the same area of substrates of the type having a base covered with a relatively light color, opaque, open cell microvoid-containing layer that is rendered translucent when the microvoids are filled with a liquid, such repeated use leaving no visible race of previously applied indica.

2. The invention of claim 1 wherein no more than about 50 ppm of said fluid as delivered constituents a substance having an evaporation rate less than one-half that of said liquid.

3. The invention of claim 1 wherein no more than about 5 ppm of said fluid as delivered constituents a substance having an evaporation rate less than one-half that of said liquid.

4. The invention of claim 1 wherein the reservoir comprises a bundle of fine fibers enclosed in a tubular film sheath.

5. The invention of claim 4 wherein the device is a pen having, as the delivery means, a relatively stiff, axially porous elongate polymeric nib, one end of which extends into said reservoir, the other end extending from the receptacle to provide the means for applying marks to a substrate.

* * * * *

UNITED STATES PATENT AND TRADEMARK OFFICE

CERTIFICATE OF CORRECTION

PATENT NO. : 4,729,687

DATED : March 8, 1988

INVENTOR(S) : Robert P. Arens

It is certified that error appears in the above-identified patent and that said Letters Patent is hereby corrected as shown below:

In the Abstract, second line change "substrate" to -- substrates --

Col. 2, line 38, change "by" to -- be --.

Col. 3, line 59, after "50,000 ppm." insert the following, which was omitted by the printer --

The three other pens were then tested in the same manner as the control, with the following exceptions:

Example 1 -- PVC vent tubes were removed.

Example 2 -- PVC vent tubes were removed and the receptacle was carefully rinsed with acetone and dried. Additionally, before filling with isoparaffin, the tubular reservoir was placed so that the lower end was in a tray of acetone and an absorbent mat of blown microfibers was in contact with the upper end. As the acetone wicked upward through the fibers, contaminants were carred with it. After 7 hours the reservoir was inverted, and a drop of liquid squeezed from the upper end, placed on a microscope slide, and allowed to evaporate. If significant residue remained on the slide, the process was continued until a --

UNITED STATES PATENT AND TRADEMARK OFFICE

CERTIFICATE OF CORRECTION

PATENT NO. : 4,729,687

DATED : March 8, 1988

INVENTOR(S) : Robert P. Arens

It is certified that error appears in the above-identified patent and that said Letters Patent is hereby corrected as shown below:

Col. 3, in the footnote, lines 6-8 of the footnote after "results." delete "subsequent drop left no perceptible residue after evaporation, after which the reservoir was air dried at least 16 hours. (The major contaminant was found to be glycerol tributyrate.)" and add it at the end of the insertion referred to above.

Signed and Sealed this

Twentieth Day of September, 1988

*Attest:*

*Attesting Officer*

DONALD J. QUIGG

*Commissioner of Patents and Trademarks*